United States Patent [19]

Kane

[11] 4,008,034

[45] Feb. 15, 1977

[54] BRICK MAKING MACHINE HAVING STRIPPING MEANS

[76] Inventor: Joseph F. Kane, c/o Kane-Gonic Brick Corp., Gonic, N.H. 03867

[22] Filed: Oct. 1, 1975

[21] Appl. No.: 618,319

[52] U.S. Cl. ..... 425/441; 249/160; 425/439; 425/454

[51] Int. Cl.[2] ..... B28B 13/05

[58] Field of Search .... 425/88, 439, 441, 452–454, 425/443, DIG. 200–DIG. 201; 249/137, 160

[56] References Cited

UNITED STATES PATENTS

| | | | |
|---|---|---|---|
| 1,574,565 | 2/1926 | Ferguson | 425/439 |
| 3,032,851 | 5/1962 | Gibbs | 425/439 |
| 3,577,610 | 5/1971 | Margolin et al. | 425/454 |
| 3,602,963 | 9/1971 | Lingl | 425/455 |
| 3,611,518 | 10/1971 | Glass | 425/452 |

FOREIGN PATENTS OR APPLICATIONS

| | | | |
|---|---|---|---|
| 113,510 | 1/1967 | Netherlands | 425/454 |

*Primary Examiner*—Robert L. Spicer, Jr.
*Assistant Examiner*—John McQuade
*Attorney, Agent, or Firm*—C. Yardley Chittick

[57] ABSTRACT

In an automatic water struck brick molding machine including a mold for molding wet clay into bricks, releasing the suction between the wet clay in the mold and the overlying slide board by pushing the slide board across the mold for a limited distance and then forcing the slide board upwardly from said mold and immediately thereafter, raising said mold and slide board vertically far enough to leave a group of wet bricks resting on an underlying pallet ready to go to the drying area.

7 Claims, 10 Drawing Figures

BRICK MAKING MACHINE HAVING STRIPPING MEANS

BACKGROUND OF THE INVENTION

In the manufacture of bricks, old and well understood procedures are used. A wooden mold, open top and bottom and initially resting on a separate wooden bottom section called a slide board, is placed under a large press which forces wet clay downward simultaneously into all the mold compartments. When the press retracts, the now filled mold resting on the slide board is moved laterally from the press. The top surface of the clay is smooth and flush with the top surface of mold.

The filled mold is then covered with a pallet which is a metal sheet large enough to overly the mold and the clay contents. The complete unit consisting of the slide board bottom, the pallet top and the filled mold therebetween is moved by a conveyor to a so-called dumper, a device which inverts the unit to place the pallet on the bottom and the slide board on top.

The next operation according to the prior practice calls for the removal of the slide board from the top of the mold. This is followed by vertical lifting of the mold away from the wet bricks, so that the bricks remain side by side on the metal pallet.

The pallets with the wet bricks thereon are collected on racks and taken to a drying area. After sufficient drying, the bricks are fired in kilns all according to well understood procedures.

Following the separation of the slide board from the mold and the mold from the wet bricks, a conveyor takes the mold and slide board (then repositioned on the top of the mold) to another dumper which inverts the parts to place the slide board on the bottom with the mold on top. The mold and slide board then pass through a water spray which thoroughly wets the four vertical sides of each mold compartment and the upper surface of the underlying slide board. This occurs just prior to the mold again being placed in the press to receive the next charge of wet clay.

The application of water to the mold acts as a lubricant to facilitate subsequent removal of the mold and gives the finished brick surface a distinctive texture so that bricks so made are called "water struck" bricks.

SUMMARY OF THE INVENTION

The invention of the present application is particularly concerned with the construction of the slide board in relation to the mold so that through the use of novel automatically operated mechanisms, the slide board, when the mold unit is at the mold removal station, can first be slid a limited distance across the top of the mold to partially expose the upper surfaces of the wet bricks thereby to relieve the suction effect. Simultaneously with the release of the suction, the slide board is lifted a short distance to be physically separated from the upper surfaces of the wet bricks in the mold. This lifting is done by a device known as a slide lifter in which the slide board is mounted. Immediately after the slide board is separated from the mold, the slide lifter and the mold therewithin are picked up by other lifting means which lifts the mold and the slide board clear of the wet bricks which remain behind on the pallet. The pallet with the bricks thereon is then removed by a conveyor to be collected with other preceding and subsequent pallets on a wheeled rack which will be moved to a drying location.

The mold and slide board are then carried by the lifting means to another adjacent conveyor which takes the empty mold and slide board with its associated slide lifter to a dumper (an inverter) whence the unit goes to the water spray to be ready for re-insertion in the clay loading press.

DESCRIPTION OF A PREFERRED EMBODIMENT

Figure 1:
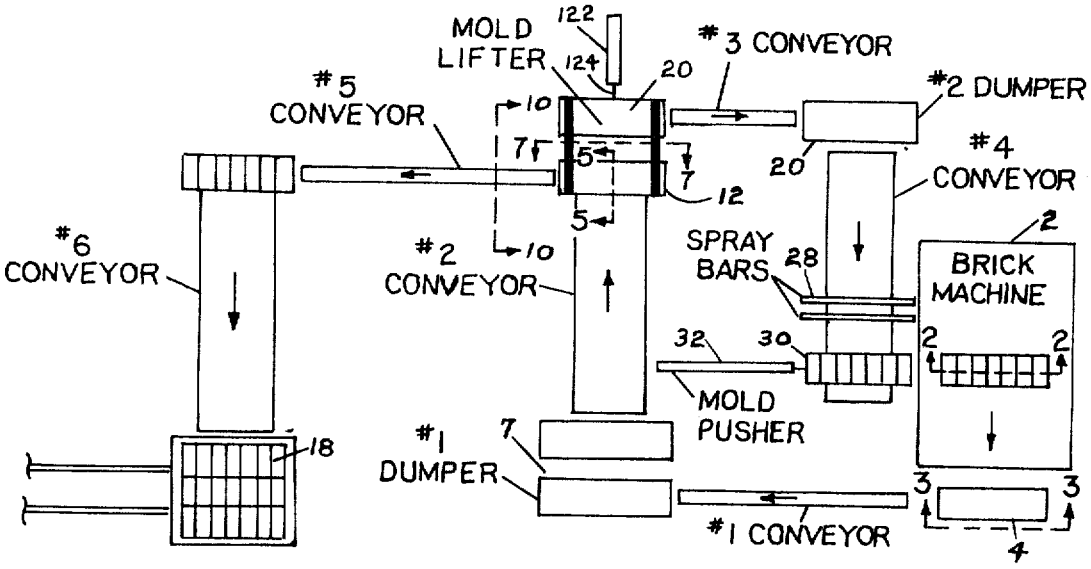
FIG. 1 is a schematic overall plan view of the brick making machinery.

The plan view of the brick making machinery shown in FIG. 1, includes a brick machine 2, in which the wet clay is pressed into a mold 3. The mold is delivered to a station 4, at which position an operator places an inverted pallet 6 on top of the mold. The mold then travels along number 1 conveyor to number 1 dumper, at which the unit is turned upside down so that pallet 6 applied to the top of the mold at station 4, is now on the bottom, and the slide board 8 and slide lifter 10 are on the top of the mold. The unit in this condition then travels along number 2 conveyor to station 12, where the mold, slideboard and slide lifter are raised vertically leaving the wet bricks 14 on the pallet 6. The pallet and the wet bricks are then moved by number 5 and number 6 conveyors to a collecting rack 18. The collecting rack when filled is then rolled away to a drying area.

The mold 3 when removed from the bricks at station 12, is carried to station 20 and then moved by number 3 conveyor to number 2 dumper which inverts the mold, slide board and slide lifter so that the slide lifter and slide board are on the bottom of the mold. Number 4 conveyor takes the mold past spray bars 28 which spray the interior walls of the mold and the top surface of the underlying slide board with water. On arriving at station 30, a pusher 32 drives the mold, slide board and slide lifter into the brick machine 2, where the mold will again be filled with clay and the foregoing sequence of operations will be repeated.

The operations are so timed that there are a substantial number of molds in the flow line, each moving immediately on the heels of the preceeding mold. The total output of wet bricks is controlled by the rate at which the molds can be loaded with wet clay at the brick machine 2.

Figure 2:
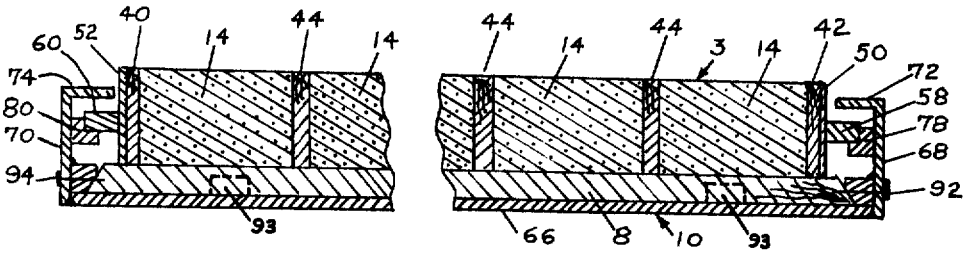
FIG. 2 is a vertical section taken on the line 2—2 of FIG. 1 showing the mold loaded with wet clay with the slide board and slide lifter in position thereunder.
Figure 8:
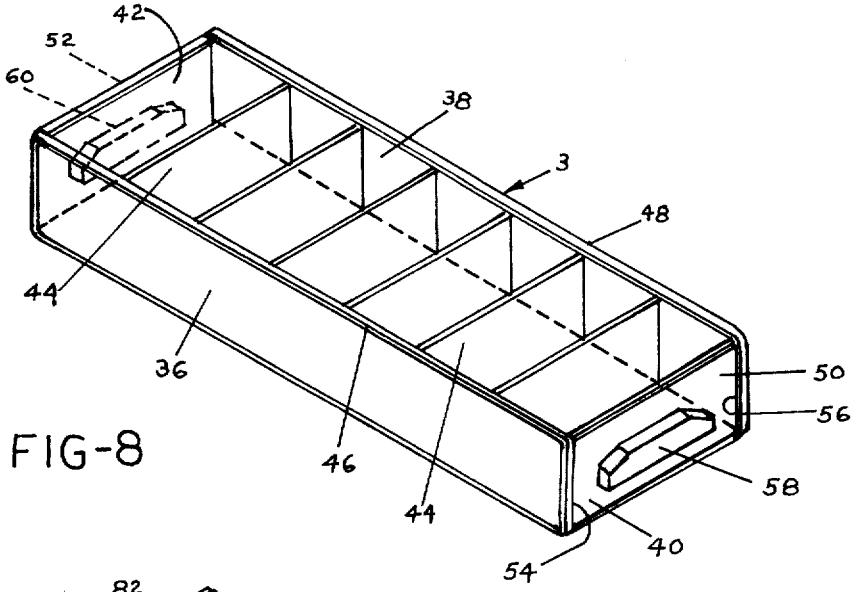
FIG. 8 is a perspective view of the mold showing the cams on the ends.

As pointed out earlier in the specification, the specific invention disclosed and claimed herein, is particularly related to the mold 3 and the means for removing the mold 3, slide board 8 and slide lifter 10 from the pallet 6 and wet bricks 14 at station 12. In order to understand the construction of the various parts, reference will first be made to FIGS. 2, 3, and 4. FIG. 2, which is a section on the line 2—2 of FIG. 1, shows the mold 3 after it has been filled with wet clay. A perspective view of the mold 3 can be seen in FIG. 8. The mold is a wooden framework having sides 36 and 38 and ends 40 and 42. A series of partitions 44, divide the mold into equal spaces which are correctly sized for the bricks to be made. The sides of the mold are banded by the steel strips 46 and 48, which extend along the top and bottom edges of the side boards 36 and 38 and cover the vertical ends of these boards as well.

The wooden ends of the molds are covered by steel plates 50 and 52 which are welded to the bands 46 and 48 at 54 and 56 respectively. Plate 50 has welded thereto a cam 58 and plate 52 has a similar cam 60 welded thereto. The shape of these cams may be seen in FIGS. 4, 5 and 6.

Figure 9:
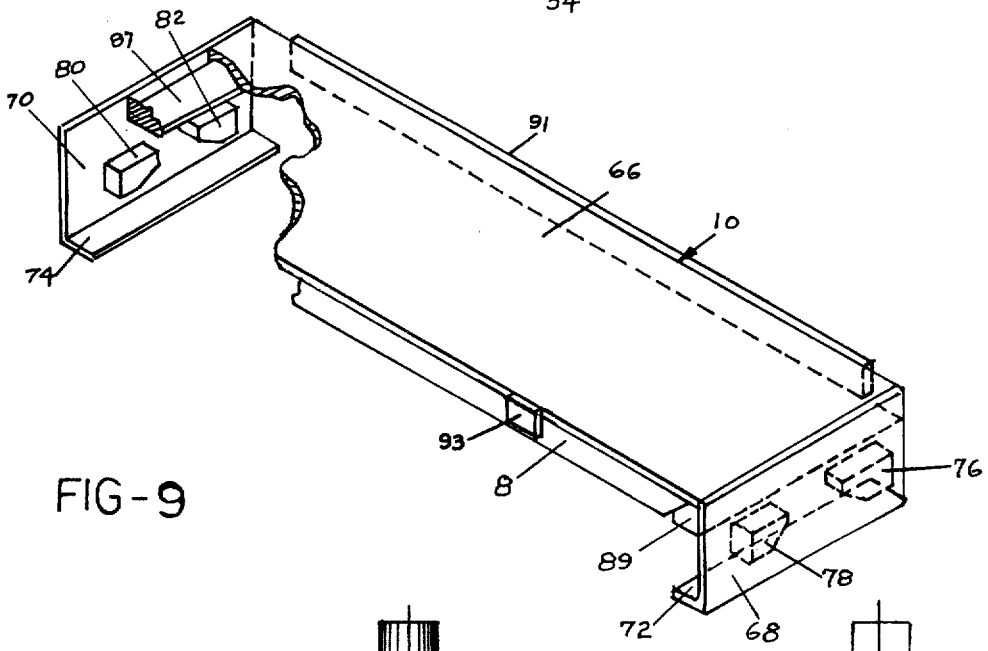
FIG. 9 is a perspective view of the slide board and slide lifter and the cams which cooperate with the cams on the mold.

When the mold is inserted into the brick machine 2, it is resting on slide board 8, which is of substantially the same dimensions as the outside dimensions of the mold. The slide board 8 in turn rests on slide lifter 10 which consists of a flat steel plate 66, large enough to cover the bottom of slide board 8. Plate 66 has vertical end plates 68 and 70. These end plates terminate in inturned flanges 72 and 74. The end plates 68 and 70 have on their interior faces pairs of spaced cams. Those cams on plate 68 are designated 76 and 78 and those on plate 70 are designated 80 and 82. (see FIG. 9).

The cams 76, 78 and 80, 82 on the end plates 68 and 70 of the slide lifter 10 are designed to cooperate with the cams 58 and 60 on the ends of the mold in a manner hereinafter explained.

The ends of slide board 8 are beveled as at 84 and 86 to fit into corresponding notches 88 and 90 in the corner reinforcements 87 and 89 of slide lifter 10. This construction prevents slide board 8 from becoming vertically dislodged with respect to slide lifter 10.

The slide board 8 is held against lateral movement with respect to slide lifter 10 by vertical flange 91 secured on one side of plate 66 and clips 93 mounted on the opposite side of plate 66. When a new slide board is needed the clips 93 are removed, the old slide board is withdrawn from the slide lifter 10 and the new slide board is inserted between corner reinforcements 87 and 89 of the slide lifter 10 until it engages flange 91. The clips 93 are then replaced to lock the new slide board in position in the slide lifter.

For additional security if deemed necessary, nails 92 and 94 (see FIG. 2) may be inserted through suitable holes in the end plates 68 and 70 of the slide lifter and driven into the ends of slide board 8. The nails of course are removed when the slide board is to be replaced.

Figure 3:
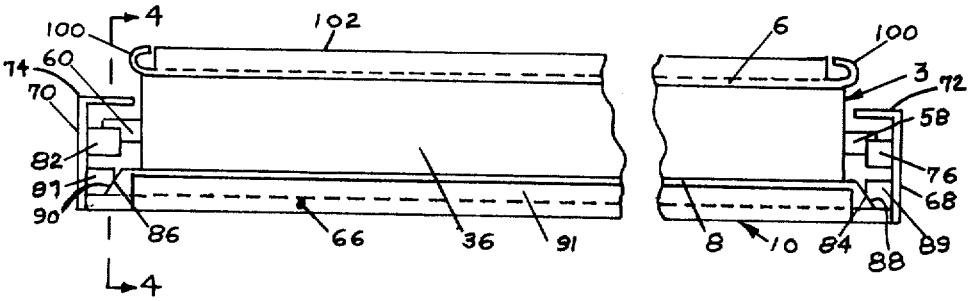
FIG. 3 is a side elevation of the mold after it has left the press taken on the line 3—3 of FIG. 1 and in which an inverted pallet has been placed on top of the mold.
Figure 4:
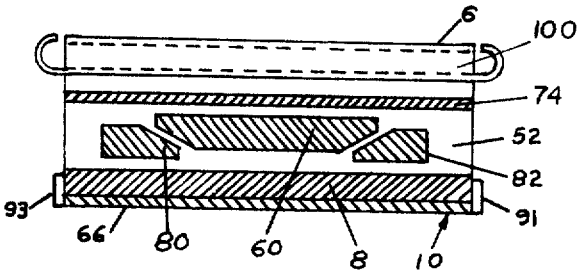
FIG. 4 is an enlarged vertical section taken on the line 4—4 of FIG. 3 showing the cams in elevation.

As shown in FIG. 2, the mold with the slide board 8 on the bottom thereof, has been loaded by the brick machine 2 with wet clay indicated in the several mold compartments at 14. The filled mold is automatically ejected from brick machine 2 to arrive at station 4 where an operator places on the top thereof an inverted pallet 6. The ends and sides of the pallet as shown in FIG. 3 have upturned portions 100 and 102 which act as legs and give rigidity to the pallet when the unit is subsequently inverted.

Figure 5:
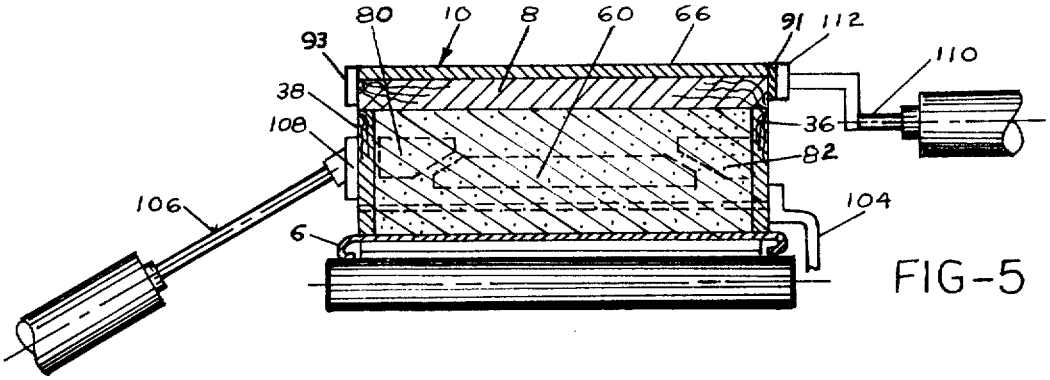
FIG. 5 is a vertical section taken on the line 5—5 of FIG. 1 showing the pusher that holds the mold stationary and another pusher in position to move the slide board and slide lifter to bring the separating cams into action.
Figure 6:
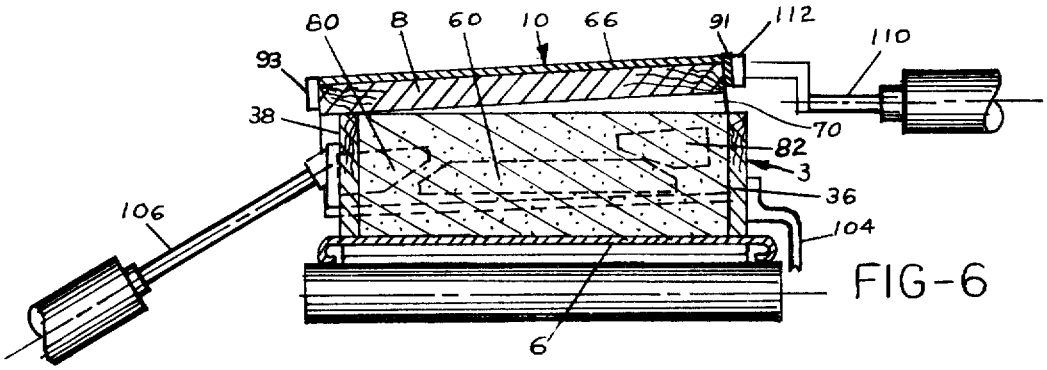
FIG. 6 is similar to FIG. 5 but shows the separation of the slide board from the mold after the pusher has been actuated to move the slide board transversely.

The loaded mold unit passes from station 4 by number 1 conveyor to the dumper 7 which inverts it so that the pallet 6 now forms the bottom of the unit and the top of the mold is covered by the slide board 8 and the related slide lifter 10. The inverted unit then passes along number 2 conveyor to station 12 where as shown in FIG. 5 it engages a stop 104. Immediately thereafter a piston 106 is actuated bringing a pressure foot 108 to bear against the wall 38 of the mold to hold the mold unit in fixed position. (see FIG. 5) Immediately thereafter another piston 110 is actuated to bring a pressure foot 112 against the flange 91 attached to the side of the overlying plate 66 of slide lifter 10. The piston 110 is then further extended so that pressure foot 112 pushes slide lifter 10 and the related slide board 8 sidewise a sufficient distance so that the top surfaces of the clay in the mold compartments are partially exposed. As sidewise movement of slide board 8 continues, the cam 82 attached to end plate 70 of the slide lifter 10 and the cam 76 attached to the other end plate 68 of slide lifter 10 engage cams 60 and 58 that are mounted on the ends of the mold 3 with the result that slide lifter 10 and slide board 8 connected thereto are raised to a slightly tilted position from the top of mold 3 as shown in FIG. 6. The initial lateral movement of slide board 8 to partially expose the top of the clay in the mold compartments eliminates the suction effect that would otherwise be present. In this manner, the slide board 8 is separated from the top surface of the mold and the wet bricks therein.

While there are two cams on each end plate of the slide lifter, namely cams 76 and 78 on end plate 68 and cams 80 and 82 on end plate 70, only one cam is put to use in raising the slide board. The reason for incorporating the second cam is so that when the mold and slide board and its related slide lifter are put together, the operator does not have to consider the relationship of the slide lifter cams to the cams 58 and 60 on the ends of the mold.

Figure 7:
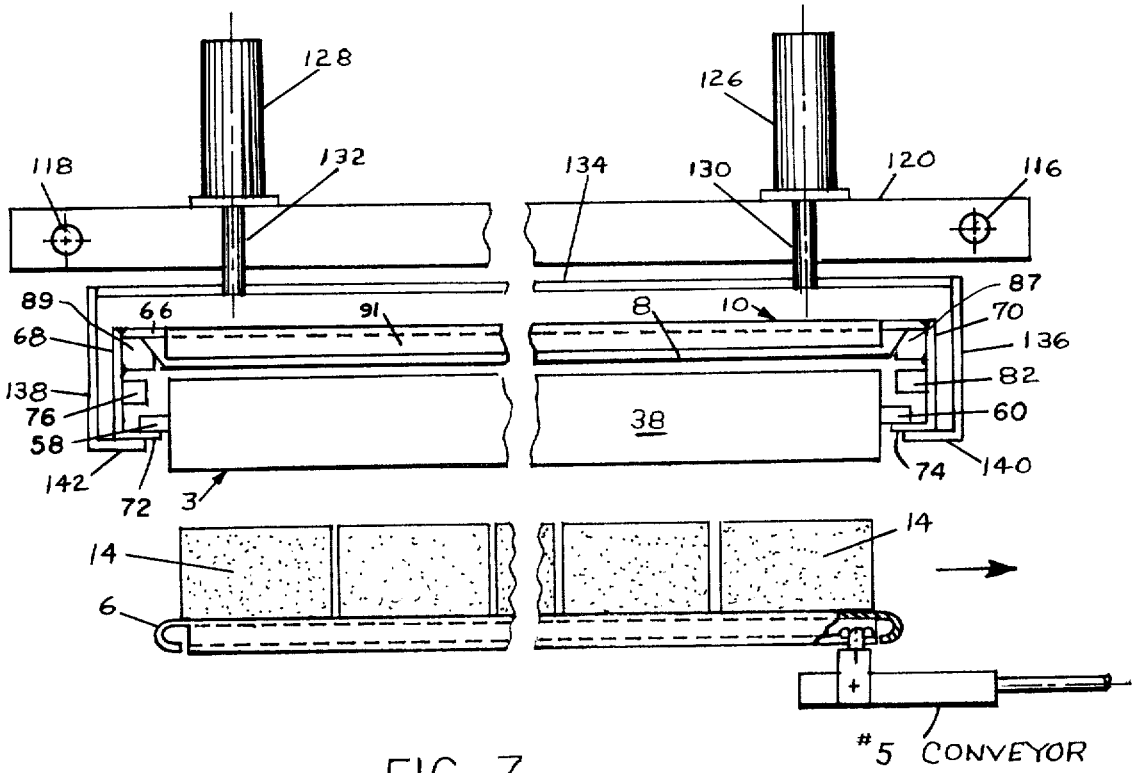
FIG. 7 is an elevation taken on the line 7—7 of FIG. 1 showing how the lifting means has raised the mold, slide board and slide lifter from the wet bricks which remain on the pallet.
Figure 10:
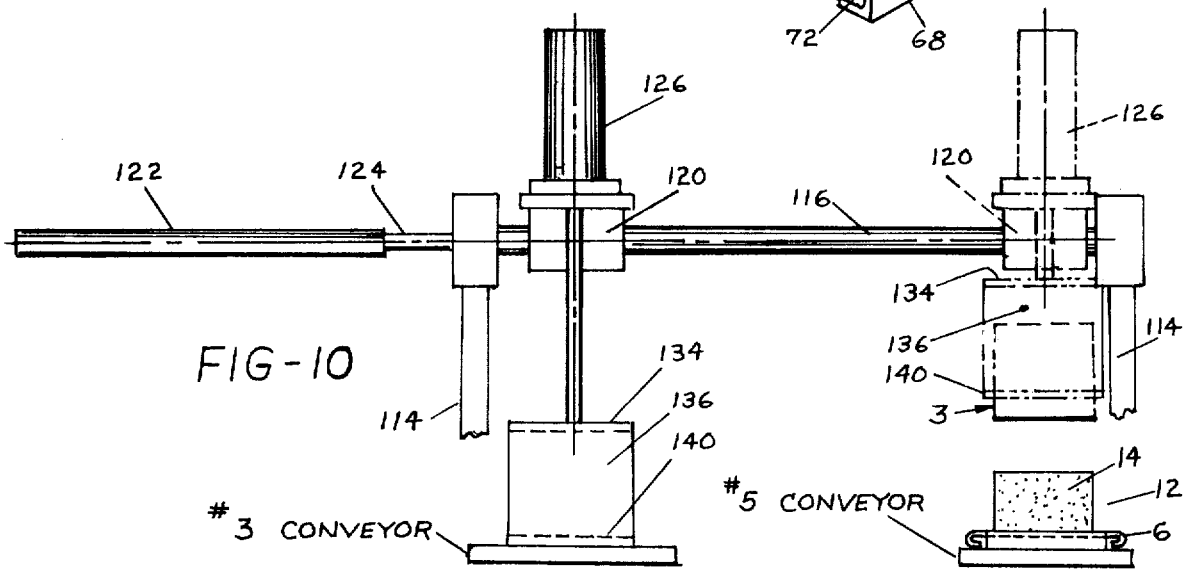
FIG. 10 an elevational view taken on the line 10—10 of FIG. 1 showing the lifting means which removes the mold from the bricks and places the empty mold on a conveyor to be returned to the brick machine.

In the meanwhile, while the separation of slide board 8 from mold 3 is occurring as shown in FIG. 6, the mold lifter shown in FIGS. 7 and 10 has come into action. Referring to FIG. 10, the mold unit is at station 12. Positioned thereover and carried by a suitable framework indicated at 114 are a pair of parallel rods 116 and 118 which carry a horizontal support 120. A cylinder 122 and related piston 124 are connected to member 120 so that upon extension of piston 124 member 120 can be moved from the solid line position in FIG. 10 to the dotted line position over the mold unit 3 then at station 12. As can be seen in FIG. 7, member 120 has mounted thereon a pair of cylinders 126 and 128 from which depend pistons 130 and 132. These pistons carry a mold lifter in the form of an inverted U-shaped frame comprised of a top plate 134, and depending end plates 136 and 138, from which extend inturned flanges 140 and 142. The height of the end plates 136 and 138 and the spacing of the inturned flanges 140 and 142 are such that this inverted U-shaped element when moved to station 12 by extension of piston of 124 will surround the mold unit on the top and ends.

When the pistons 130 and 132 are raised, (see FIG. 7) the flanges 140 and 142 of the mold lifter will engage the flanges 72 and 74 so that the slide lifter 10 will be raised. As the slide lifter starts upward the flanges 72 and 74 will engage the undersides of cams 58 and 60 which are attached to the ends of mold 3. This causes the mold to be lifted from the wet bricks 14 which because of their weight maintain their position on top of pallet 6 as shown in FIGS. 7 and 10.

Before the mold has been lifted from the wet bricks, as shown in FIG. 7, the pistons 106 and 110 and their respective related pressure feet 108 and 112 will have been retracted so as not to interfere with the upward movement of the mold as it is raised by the mold lifter.

As soon as the mold has been moved upwardly by the mold lifter as shown in FIGS. 7 and 10 to clear the tops of the bricks 14, the pallet 6 and the wet bricks 14 thereon are immediately taken by conveyors number 5 and 6 from station 12 to the collecting rack 18 for subsequent removal to a drying area. Simultaneously the piston 124 is retracted to move member 120 from the position over station 12 (see FIG. 10) to a position at the left where it will be over number 3 conveyor that leads to the number 2 dumper (see FIG. 1). As soon as the lifting means is over number 3 conveyor the pistons 130 and 132 are extended downward thereby lowering the mold 3 onto the conveyor. The conveyor runs continuously but movement of mold 3 and its related slide board 8 and slide lifter 10 on the conveyor is temporarily prevented because of its engagement with end plate 138 of the mold lifter. However, as soon as the next loaded mold unit reaches station 12, piston 124 will again be extended to move the mold lifter from its inactive position over number 3 conveyor to its active lifting position at station 12. Thus as soon as the mold lifter has again moved to the right as viewed in FIG. 10, the mold 3 then resting on number 3 conveyor is freed so that the mold can move to number 2 dumper station.

At the number 2 dumper station, the mold, slide board and slide lifter are inverted to be in proper loading position. The number 4 conveyor takes the unit through the sprayer to the mold pusher 32 which then places the mold in the brick machine to receive a new charge of wet clay. The process above described is continuously repeated.

I claim:

1. Apparatus for facilitating the removal of a mold from wet bricks therein, said apparatus comprising a pallet, a mold having a plurality of compartments open at top and bottom and resting on said pallet, said compartments adapted to be filled with wet clay forming wet bricks, a slide board resting on the top of said mold and covering all said compartments, a slide lifter overlying said slide board, means securing said slide board and slide lifter together, said slide lifter having a depending end plate at each end thereof, said plates spaced from the ends of said mold and at least partially overlapping the said mold ends, first cams on the ends of said mold, second cams on the depending end plates of said slide lifter shaped and positioned to cooperate with the said first cams on the ends of the said mold so that relative transverse movement of said slide board and slide lifter with respect to said mold will cause said first and second cams to function to achieve separation of said slide board from the top of said mold and from the upper surface of the wet bricks therein.

2. The apparatus set forth in claim 1, and means operatively associated with said mold for temporarily holding said mold stationary and other means operatively associated with the holding means for pushing said slide board and slide lifter transversely while said mold is being held stationary to cause said cams to function to achieve separation of said slide board from said mold.

3. The apparatus set forth in claim 1, the end plates of said slide lifter having inturned flanges which underlie said first cams, a mold lifter comprised of end plates of greater vertical dimensions than the end plates of said slide lifter, said mold lifter end plates having inturned flanges which are adapted to underlie the end plates of said slide lifter, means operatively associated with the mold lifter for moving said mold lifter from a first position adjacent said slide lifter, slide board, and mold to a second position in which said slide lifter, slide board, and mold are within the confines of said mold lifter, means operatively associated with said mold lifter for then raising said mold lifter, slide lifter, slide board and mold to a position above said pallet a distance greater than the vertical dimension of said mold, and means operatively associated with said mold lifter for returning said mold lifter, slide lifter, slide board and mold to said first position.

4. The apparatus set forth in claim 3 and means adjacent said second portion for removing said pallet and wet bricks thereon after said mold has been raised therefrom and other means adjacent said second portion for advancing another pallet, mold, slide board and slide lifter assembly to the mold removing location.

5. The apparatus set forth in claim 1, said first cams being mounted on metal plates which are affixed to the ends of said mold.

6. The apparatus set forth in claim 1, said slide lifter having reinforcements between said end plates and the portion overlying said slide board, the ends of said slide board being beveled and said reinforcements being correspondingly beveled whereby a slide board may be inserted laterally into said slide lifter.

7. The apparatus set forth in claim 3, a conveyor moving in a direction parallel to the long dimension of said mold and located below said mold lifter at said first position, means operatively associated with said mold lifter for lowering said mold lifter to deposit said mold with its related slide board and slide lifter on said conveyor and the mold lifter preventing movement of said mold on said conveyor until said mold lifter has again been moved to said second position.

* * * * *